US006667013B1

(12) United States Patent
Nilsson

(10) Patent No.: US 6,667,013 B1
(45) Date of Patent: Dec. 23, 2003

(54) CATALYTIC CONVERTER AND METHOD FOR MOUNTING OF CONVERTER

(75) Inventor: Sven Melker Nilsson, Kållered (SE)

(73) Assignee: Kemira Metalkat Oy, Vihtavuori (FI)

( * ) Notice: Subject to any disclaimer, the term of this patent is extended or adjusted under 35 U.S.C. 154(b) by 0 days.

(21) Appl. No.: 09/554,498

(22) PCT Filed: Nov. 10, 1998

(86) PCT No.: PCT/SE98/02019

§ 371 (c)(1),
(2), (4) Date: Jul. 5, 2000

(87) PCT Pub. No.: WO99/27240

PCT Pub. Date: Jun. 3, 1999

(30) Foreign Application Priority Data

Nov. 21, 1997 (SE) ..... 9704265

(51) Int. Cl.[7] ..... F01N 3/28; B01D 53/88
(52) U.S. Cl. ..... 422/180; 422/177; 29/890
(58) Field of Search ..... 60/299, 301, 302; 422/177, 180; 29/890

(56) References Cited

U.S. PATENT DOCUMENTS 3,935,705 A * 2/1976 Hergoualch ..... 60/302
5,408,827 A * 4/1995 Holtermann et al. ..... 60/298
5,444,978 A 8/1995 Yoshizaki et al.
5,782,088 A * 7/1998 Gunther et al. ..... 60/278
6,182,446 B1 * 2/2001 Gunther et al. ..... 60/278

FOREIGN PATENT DOCUMENTS

| | | |
|---|---|---|
| DE | 4442456 A1 | 5/1996 |
| EP | 0298943 | 1/1989 |
| EP | 0629771 A2 | 12/1994 |
| EP | 0761939 A1 | 3/1997 |
| SE | 461018 | 12/1989 |
| WO | WO 9634188 A1 | 10/1996 |

* cited by examiner

*Primary Examiner*—Hien Tran
(74) *Attorney, Agent, or Firm*—Burns, Doane, Swecker & Mathis, L.L.P.

(57) ABSTRACT

Catalytic converter for treatment of exhaust gas from combustion engines, comprising a metal monolith (13) held together by interlocking ridges (15) between spirally wound layers without brazes or welds, with a mantle (14) held to the monolith by the same type of interlocking ridges (16), and where the mantle has an integral clamping flange (17) which is clamped between the exhaust manifold (12) and an exhaust port (11) of the engine block (10).

7 Claims, 1 Drawing Sheet

CATALYTIC CONVERTER AND METHOD FOR MOUNTING OF CONVERTER

BACKGROUND

It is generally accepted that one way to ensure that catalytic converters for internal combustion engines fulfil the requirements for rapidly becoming active after starting the engine, is to provide a first converter close to the engine manifold, where the exhaust gas from the beginning has a high enough temperature to effect a light-off of the converter, and a second converter further down along the exhaust pipe where temperature and vibration are less demanding. Such divided converter systems are described in patents U.S. Pat. No. 5,444,978, EP 629 771, EP 761 939, and DE 44 42456. The extreme oscillations of pressure and temperature, as well as the high peak temperature make it difficult to get sufficient lifetime of the first manifold converter, and many suggested designs include means for easy replacement, or for bypassing it as soon as the second, main converter is operative, as shown in DE 44 42456.

The present invention is a new type of manifold converter and a way to mount it close to the engine, where the converter is less vulnerable to heat fluctuation and vibration, and where a rapid light-off is assured.

DESCRIPTION

The converter and its mounting is described with reference to the figures, where FIG. 1 shows the configuration of the engine system, FIG. 2 a section through part of the engine and manifold with the manifold converter.

Catalytic converters usually comprise a monolith body with numerous parallel channels, the inner surfaces of which are coated with active catalyst layers. The monolith is commonly either an extruded ceramic body or a multiple of smooth and corrugated metal foils joined by brazing or welding. Ceramic bodies are brittle, however, and have to be elaborately mounted with resilient padding. Brazed or welded metallic monoliths develop large thermal stresses, and at their elevated temperatures there is a great risk of failure of welds or brazes.

The invention will now be described more in detail by reference to the enclosed drawing which illustrates a preferred embodiment of the invention.

Figure 1:
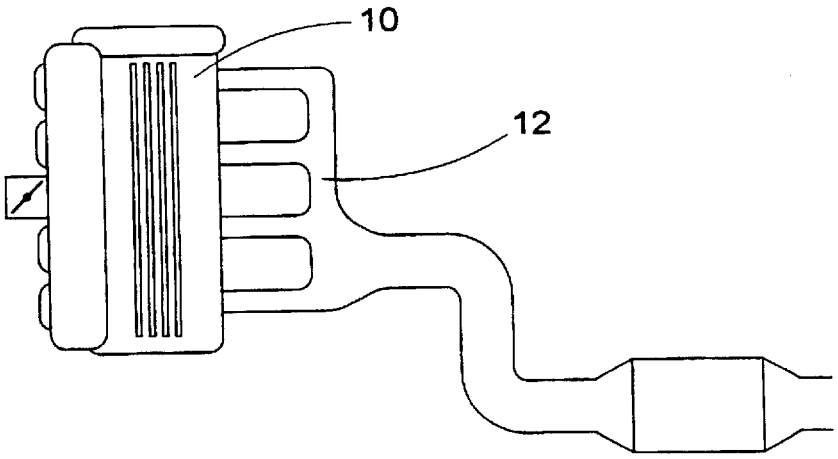
FIG. 1 is a side view of a device according to the invention.
Figure 2:
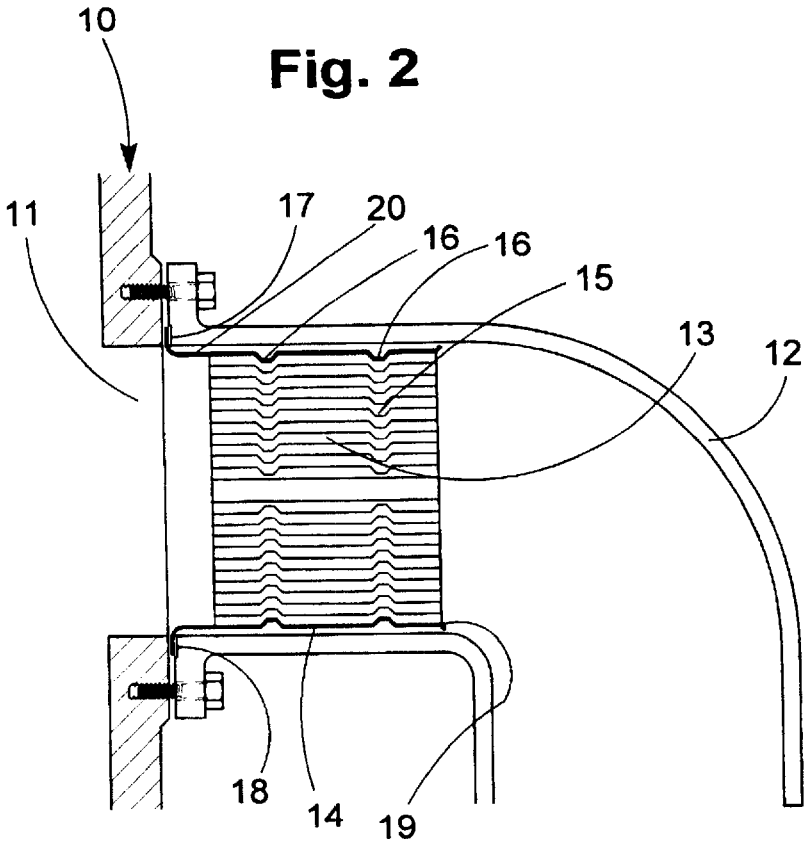
FIG. 2 is a cross section of the device shown in FIG. 1.

According to the invention, catalytic converters with a metal monolith (13) are mounted between the engine exhaust ports (11) in the engine block (10) and the manifold (12), one converter per cylinder. Compared to designs with one converter per manifold, this leads to a lower average temperature and less risk of creep failure of the metal, but a wider temperature range. The monolith (13) and its mantle (14) can then be made of thinner metal than would otherwise be possible.

To reduce the thermal stresses in radial and tangential directions, the monolith (13) is made without brazes or welds, and the layers held together mechanically by tangential inward ridges (15) of smooth metal foils interlocking with notches in the corrugations of the corrugated metal foils, as described in patent SE 461 018. Variations in thermal expansion will then be accepted as radial play or as slight rotation of the inner parts relative to the outer parts. The ridges (15) of this design also have the added advantage of equalizing the turbulence in the axial direction, to make the whole length of the converter equally active, reduce the longitudinal thermal stresses and allow a comparatively short converter.

The converter is located at the exhaust port (11) of the engine, where the variations in exhaust gas velocity are greatest, which also ensures sufficient turbulence and lets the ignition point for the catalytic reaction fluctuate somewhat to avoid overheated spots.

One major advantage with the mechanical interlocking, as compared with brazing or welding, is that the mantle (14) around the monolith layers can be made much thinner than with other designs and interlock with the layers through the same type of tangential inward ridges (16). In previous designs, the mantle is so heavy and the monolith so long, that it has to be suspended at both ends, but according to the invention, it is sufficient to provide the thin mantle with a flange (17) behind or in front of the monolith (13). The thickness of the mantle is preferably in the range from 0.1 to 0.5 mm, and the length of the monolith from 25 to 50 mm. The mantle and the flange are preferably made from one integral piece of material by deep drawing or swaging.

The flange is clamped between the engine block (10) and the manifold (12). No bolt holes are needed in the flange (17). The mantle should not touch the inside of the manifold, but have a distance of a few millimeters, which should be open, without any insulating mat. To keep the converter centered in the manifold, a shallow recess (18) can be made in either the manifold or the engine block, or the neck (20) of the mantle between the flange and the monolith be made with locally raised areas. It can also be advantageous to extend the mantle past the monolith as a very narrow flange (19) which does not normally carry any load, but serves to guide the converter during the mounting operation to avoid scratching the mantle (14).

In the figures and the description, the converters have been described as extending into the manifold (12), which is a prefered embodiment with best mechanical stability, but for engine blocks of certain types or especially tightly bent manifolds, it is also possible to turn it with the monolith extending into exhaust port (11) of the engine block.

Catalytic converters made and mounted according to the invention can also be fitted to existing engines with little extra effort, compared to prior types which require redesigned or duplicated manifolds.

What is claimed is:

1. A catalytic converter for treatment of exhaust gas from combustion engines, comprising a metallic mantle and a metallic monolith spirally wound from one or more metal foils, held together and held to the mantle by interlocking tangential ridges without brazing or welding, the mantle having a clamping flange for clamping between parts of the engine exhaust system, the mantle having a thickness of 0.1 mm to 0.5 mm.

2. The catalytic converter according to claim 1, the flange and the mantle being integrally formed from a single piece of material.

3. The catalytic converter according to claim 1, the flange being located at one end of the mantle.

4. The catalytic converter according to claim 3, the monolith being located entirely on one side of the flange.

5. The catalytic converter according to claim 3, further comprising: a small guidance flange at an end opposite to the clamping flange.

6. A method of mounting a catalytic converter in exhaust system of a combustion engine, the catalytic converter having a metallic mantle and a metallic monolith spirally wound from one or more metal foils, held together and held to the mantle by interlocking tangential ridges without brazing or welding, the mantle having a clamping flange for clamping between parts of the exhaust system, the mantle having a thickness of 0.1 mm to 0.5 mm ,the method comprising the steps of separating the exhaust manifold from the engine block, inserting between the manifold and the engine block a the catalytic converter with a clamping flange and a cylindrical monolith part, at least one converter for each engine cylinder, centering the converter so that the mantle of the cylindrical part does not touch the inside of the exhaust system, replacing the exhaust manifold and bolting it to the engine block 1, thereby clamping the flange between the manifold and the engine block.

7. The method according to claim 6, wherein the cylindrical monolith part of the converter extends into the manifold.

* * * * *